US005308043A

United States Patent [19]

Floyd et al.

[11] Patent Number: 5,308,043

[45] Date of Patent: May 3, 1994

[54] TOP SUBMERGABLE LANCE

[75] Inventors: John M. Floyd, Upper Beaconsfield; Kok T. Wong, Burwood; Ian L. Chard, Cranbourne, all of Australia

[73] Assignee: Ausmelt Pty. Ltd., Australia

[21] Appl. No.: 947,771

[22] Filed: Sep. 18, 1992

[30] Foreign Application Priority Data

Sep. 20, 1991 [AU] Australia ..... PK8457

[51] Int. Cl.[5] ..... C21C 5/32

[52] U.S. Cl. ..... 266/78; 266/87; 266/89; 266/225; 266/226

[58] Field of Search ..... 266/225, 226, 87, 78, 266/89

[56] References Cited

U.S. PATENT DOCUMENTS

| | | | |
|---|---|---|---|
| 3,321,139 | 5/1967 | De Saint Martin | 266/225 |
| 3,411,716 | 11/1968 | Stephan et al. | 266/225 |
| 3,488,044 | 1/1970 | Shepherd . | |
| 3,521,872 | 7/1970 | Themelis . | |
| 3,730,505 | 5/1973 | Ramaccioti et al. . | |
| 3,802,681 | 4/1974 | Pfeifer . | |
| 3,828,850 | 8/1974 | McMinn et al. . | |
| 3,876,190 | 4/1975 | Johnstone et al. | 266/225 |
| 3,889,933 | 6/1975 | Jaquay . | |
| 4,023,676 | 5/1977 | Bennett et al. . | |
| 4,097,030 | 6/1978 | Desaar . | |
| 4,251,271 | 2/1981 | Floyd . | |
| 4,326,701 | 4/1982 | Hayden, Jr. et al. . | |
| 4,396,182 | 8/1983 | Schaffar et al. . | |
| 4,541,617 | 9/1985 | Okane et al. . | |

FOREIGN PATENT DOCUMENTS 9105214 4/1991 World Int. Prop. O. .

OTHER PUBLICATIONS

Article entitled "Simultaneous Increase of Scrap and Metal Yield in the BOF in Combination with Bath Stirring" P. J. by Kreijger published in *Mixed Gas Blowing In Steelmaking*, The Iron & Steel Society of AIME (1982) pp. 23-26.

*Primary Examiner*—Melvyn J. Andrews

*Attorney, Agent, or Firm*—Watts, Hoffmann, Fisher & Heinke Co.

[57] ABSTRACT

The top-submergable injection lance has an elongate conduit which extends between upper and discharge ends and defines a bore, for the supply of reactants, through the conduit and an annular, alloy steel tip at the discharge end. The conduit comprises an inner pipe defining the bore, an outer pipe, and a third pipe which divides an annular volume between the inner and an outer pipes for circulation of coolant fluid. The tip is defined by inner and outer peripheral surfaces merging at a sharp lower edge and a top surface extending between the peripheral surfaces. The top surface of the tip joins the inner and outer pipes so as to be contactable by the coolant fluid. The frusto-conical inner peripheral surface provides a continuation of the bore which increases in cross-section to an opening at the lower edge. The lance further includes a shroud pipe around an upper part of the conduit, the shroud pipe defining a shroud gas discharge passage which is closed at the upper end of the shroud pipe and open at the lower end at a level spaced from the tip. In use, shroud gas is able to be discharged into a furnace space, above a slag bath, curing the course of top submerged injection of reactants into the bath.

15 Claims, 1 Drawing Sheet

TOP SUBMERGABLE LANCE

This invention relates to a new lance for top submerged injection into a metallurgical bath, such as in a smelting and/or refining furnace.

One form of top submerged lance injection procedure is that of the SIROSMELT process, utilising a SIROSMELT lance. In that procedure, the lance is lowered so that its lower, discharge end is a suitable distance above the slag layer of a bath. Injection of fluid, such as of air and/or oxygen is commenced. This causes a lower portion of the lance to be splashed by slag, to form a coating of solid slag thereon which protects the lance from extremes of furnace temperatures. The lance then is lowered so that its lower end is inserted into the slag, while continuing injection, and a required top submerged injection operation is conducted. During that operation, the solid slag coating is maintained above the slag layer of the bath, due to the cooling influence of the injected fluid, while the coating provides some protection of the lance against temperatures prevailing in the gas space above the bath.

While the SIROSMELT procedure can provide a substantial degree of protection for the lance, the life of the lance is limited, particularly where temperatures above the bath are extreme. Frequent maintenance of the lance therefore is necessary under such conditions. In particular, the SIROSMELT lance is not suitable for smelting and reduction of iron-containing feed materials, to produce metallic iron such as pig iron or iron with less carbon than pig iron, since the conditions of temperature, and also oxygen enrichment and bath composition required, cause rapid lance failure.

The present invention seeks to provide a new form of lance, and an improved top submerged injection system incorporating such lance. The lance of the invention can be used for injecting fluid into a slag bath, such as fuel and oxygen source gas to provide heat as well as vigorous stirring, to achieve rapid and efficient reactions.

The lance of the invention has elongate conduit which, relative to the orientation of the lance in use, extends from an upper end inlet section to a lower, process fluid discharge end. The conduit defines a longitudinal bore extending therethrough from the inlet section, to an opening defined at the process fluid discharge end by an annular tip member mounted on the conduit, such that reactants for top submerged injection can be supplied through the bore. Between the inlet section and the discharge end, the conduit comprises an inner pipe which defines the bore, and an outer pipe; with an annular volume being defined between those pipes. At or adjacent the inlet section, the conduit is provided with a first and second connector each communicating with the annular volume, with the first and second connectors adapted for respective connection to a coolant fluid supply line and a coolant fluid discharge line. Also, the lance includes a third pipe which is intermediate the inner and outer pipes and divides the annular volume into an inner and an outer annular chamber. The third pipe extends from the inlet section, but terminates a relatively short distance above the process fluid discharge end such that the chambers are in communication at the process fluid discharge end. Each connector communicates with a respective one of the chambers, such that, in use, coolant fluid is able to flow from the first connector, through one of the chambers to the discharge end of the lance, and then return through the other of the chambers for discharge through the second connector.

Most preferably the first connector communicates with the inner chamber, with the second connector enabling discharge from the outer chamber.

The annular tip at the discharge end of the conduit is connected to the lower end of each of the inner and outer pipes around the circumference of those pipes. The tip has a frusto-conical inner peripheral surface, which provides a continuation of the bore, from the inner pipe to the opening, that is of increasing cross-section from the inner pipe to the opening. The frusto-conical surface most preferably has a half-cone angle of from about 10° to about 20°, as this is found to substantially prevent blockage of the core by solidified slag. The tip may have an outer peripheral surface which merges with the frusto-conical surface at the opening, with this preferably being at a sharp, lower peripheral edge of the tip.

Mounted in the tip, the lance may have a baffle of a form which causes injected reactants to issue from the opening as an annular jet. The baffle preferably is of conical form, having an external surface which increases in cross-section from an upper end thereof to the opening. Such external surface may have a half-cone angle substantially equal to that of the inner surface of the tip.

In normal use of the lance, the reactants injected through the bore comprise fuel and oxygen, to achieve combustion of the fuel in the slag bath. The oxygen may be provided by air, oxygen-enriched air or oxygen alone or in combination with an inert gas such as nitrogen. Such gas may act as a carrier for the fuel, although it is preferred that the roles of providing oxygen for combustion and a carrier for the fuel is at least in part divided. For this, the lance may have a fuel supply pipe extending through the bore from the inlet section to, or adjacent to, the tip for injection of fuel, and a carrier gas for the fuel, via the lance opening. Where such fuel supply pipe is provided, at least part of the oxygen required for combustion then is supplied via an annular passage between the supply pipe and the inner pipe of the conduit. The arrangement preferably is such that mixing of the oxygen from the annular passage and the fuel occurs in the tip, prior to discharge from the opening.

Where such fuel supply pipe is provided, and a baffle is mounted in the tip, mounting for the baffle may be by its attachment to extensions or rods projecting beyond the lower end of the supply pipe, within the tip.

The annular passage between the fuel supply pipe and the inner pipe of the conduit may be provided with at least one swirler mounted around at least the lower end of the supply pipe, to impart helical motion to the flow of gas injected through the passage. The swirler preferably is of helical form around the supply pipe, most preferably of decreasing pitch towards the opening. The swirler may comprise a single start helical baffle member, but preferably is a two start helical baffle member. Such swirler enhances mixing of the gas injected through the passage and fuel within the tip, and enhanced distribution of reactants within the slag, thereby optimising fuel combustion.

The lance may include a shroud pipe around the conduit, over an upper part of the length of the latter from the inlet section, and defining an upper region shroud gas discharge passage between the shroud pipe and the outer pipe of the conduit. The shroud gas discharge passage is closed at the upper end of the shroud pipe but, at the lower end of the latter, is open at a level spaced from the tip. The shroud pipe has a connector which communicates with the discharge passage and is connectable to a supply of pressurised shroud gas. The arrangment is such that, in use, shroud gas is able to be discharged into the furnace space, above the slag bath, during the course of top submerged injection of reactants into the bath.

The shroud gas may provide further cooling for the lance, and discharge with furnace or reactor gases. In such case, the shroud gas may be an inert gas such as nitrogen. However, it is preferred that the shroud gas is an oxygen containing gas, such as air, oxygen-enriched air, oxygen or a mixture of oxygen and an inert gas, enabling post-combustion of furnace or reactor gases above the slag bath. Indeed, where the shroud gas is to enable post-combustion, it may be pre-heated, such as up to about 300° C., to facilitate post-combustion. Where such pre-heating occurs, it will be appreciated that the shroud gas will have a more limited capacity to also provide further cooling for the lance.

Particularly where the furnace or reactor, in which the lance is to be used, generates extreme temperature conditions, such as in smelting and reduction of iron-containing feed materials, further cooling can be desirable. Thus, exteriorly of the conduit, and of the shroud pipe if provided, a supplementary coolant fluid supply pipe arrangement can be provided around an upper part of the lance. The supplementary arrangement preferably is similar in form to that defined in the conduit by its inner, outer and third pipes.

A top submerged injection system according to the invention comprises a lance according to the invention, and lance positioning means for raising and lowering the lance. The system may include pressure, temperature and coolant flow sensing means for monitoring the coolant fluid supplied to the conduit and control means operable, in response to a signal from the sensing means indicating a drop in coolant fluid pressure or a coolant fluid pressure below a predetermined value, to shut off the coolant supply to the lance and to actuate the positioning means to raise the lance fully from its in use position.

The components of the lance exposed to high temperatures need to be of a suitable temperature and oxidation resistant metal, while components exposed to coolant fluid need to be of a metal providing corrosion resistance. In each case, it is highly preferred that the components be of a suitable grade of alloy steel, most preferably stainless steel, such as 316 or 321 grade stainless steel, such as ASTM 316 or 321 grade stainless steel or other high chromium steels.

The coolant fluid with which the lance is to be used most preferably comprises water or wet or dry steam. However, other gaseous or liquid fluids can be used.

The preferred fuel for use with the lance is pulverised or fine coal. However, other fuels such as oil can be used. Also, other materials can, if required, be injected with the fuel and oxygen, such as solid fluxes, collector phase modifiers and reaction catalysts.

In order that the invention may more readily be understood, description now is directed to the accompanying drawings, in which.

Figures 1, 2:
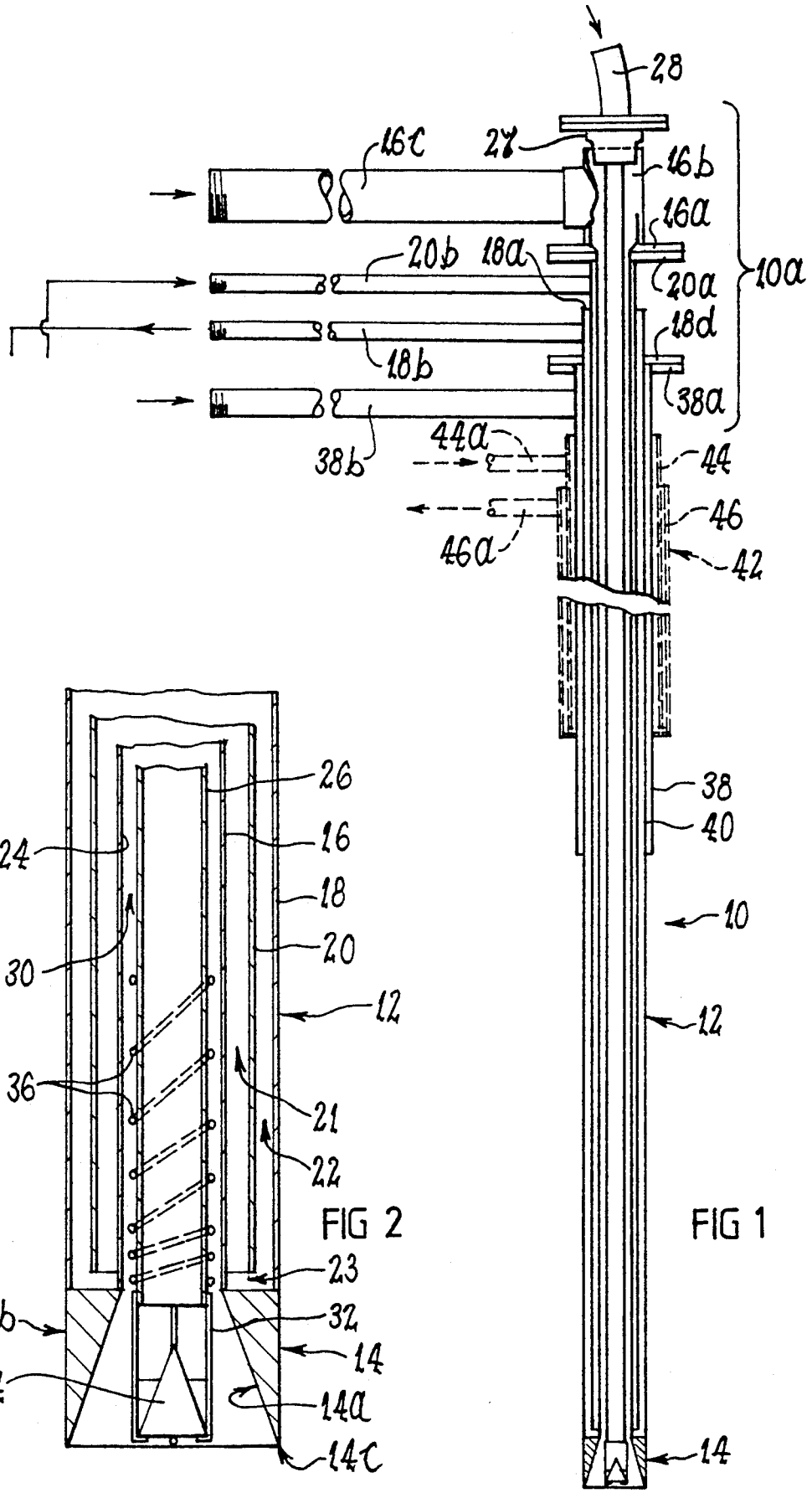
FIG. 1 is a sectional view of a lance according to the invention.
FIG. 2 is an enlarged sectional view of the lower end of the lance of FIG. 1.

The lance 10 of FIGS. 1 and 2 has conduit 12 extending from upper end section 10*a* of lance 10 to a tip 14 at the lower discharge end.

Conduit 12 includes inner and outer concentric pipes 16,18 and a third pipe 20 disposed co-axially between pipes 16,18. Tip 14 is sealingly connected to the lower end circumference of each of pipes 16,18. However, the lower end of pipe 20 terminates above tip 14 such that the volume between pipes 16,18 is divided into inner and outer annular passages 21,22 which are in communication at 23, between the lower end of pipe 20 and tip 14.

In upper end section 10*a*, passage 21 is close by co-operating, interconnected flanges 16*a*,20*a* of pipes 16,20. Similarly, passage 22 is closed by an annular radial wall 18*a* of pipe 18 which is sealed around pipe 20. Pipe 20 has an inlet connector conduit 20*b*, by which conduit 12 is connectable to a source of pressurised coolant fluid, such as water, such that coolant fluid can be supplied to passage 21. Also, pipe 18 has an outlet connector conduit 18*b*, by which conduit 12 is connectable to a discharge line for discharge of coolant fluid from passage 22. The arrangement is such that coolant fluid, for cooling conduit 12, is able to be supplied via conduit 20*b* for flow downwardly through and around passage 21, and then upwardly and around passage 22, for discharge through conduit 18*b*. In such flow, the coolant fluid flows across the upper end of tip 14, at 23, to provide cooling of tip 14.

Pipe 16 defines a bore 24 therethrough from the upper end of pipe 16 in section 10*a* to tip 14; while tip 14 provides a continuation of bore 24 to the lower end of lance 10. Concentrically within pipe 16, there is a fuel supply pipe 26 which extends from the upper end of lance 10 to a level in one example adjacent the top of tip 14. The upper end of pipe 26 is received into a collar 27 by which it is connected to a supply line 28. The latter is connectable to a source of fuel and carrier gas for the fuel, for injection of the fuel through lance 10 via pipe 26.

Between pipes 16,26 there is an annular gas passage 30 through bore 24. The upper end of pipe 16 is enlarged at 16*b*, and provided with an inlet connector conduit 16*c*, by which passage 30 is connectable to a pressurised source of oxygen or oxygen containing gas, to enable injection of such gas through lance 10.

Tip 14 is solid, and made from a suitable alloy steel such as stainless steel. It has an inner peripheral surface 14*a* which, in addition to providing a continuation of bore 24, is frusto-conical so as to taper downwardly and outwardly from the cross-section of bore 24 within pipe 16. The taper of surface 14*a* has a half cone angle of from 10° to 20°, for the reason indicated above. Surface 14*a* merges with external cylindrical surface 14*b* of tip 14, to define a sharp lower edge 14*c* of tip 14 at the outlet of lance 10.

The lower end of pipe 26 may have a plurality of circumferentially spaced rods 32 which project axially within tip 14. Mounted on rods 32, within tip 14, there is a conical baffle 34 which increases in cross-section towards the lower end of lance 10. Baffle 34 has a half angle similar to that of surface 14*a* of tip 14, and causes the flow of fuel issuing from the pipe 26 to diverge outwardly into the flow of oxygen issuing from passage 30. Baffle 34 and also surface 14*a* of tip 14 minimise entry of slag into tip 14.

Within the lower extent of passage 30, there may be a helical swirler 36 for imparting circumferential motion to oxygen issuing therefrom. Swirler 36 comprises a two-start helical baffle mounted on pipe 26, which decreases in pitch towards tip 14. Surface 14*a* of tip 14 and baffle 34 cause good mixing of the fuel and oxygen within tip 14 and this is further enhanced by the action of swirler 36. That mixing and the action of swirler 36 also result in good distribution of the fuel and oxygen within the slag in which they are injected by top submerged injection from lance 10.

Concentrically disposed on the upper extent of conduit 12, there is a shroud pipe 38. A shroud passage 40 is defined between pipes 18,36, with passage 40 being closed at its upper end by respective flanges 18*d* and 38*a* of those pipes. Pipe 38 has an inlet conduit 38*b* communicating with passage 40 and connectable to a pressurised source of shroud gas, such as an oxygen-containing gas for post-combustion above a slag bath as detailed herein. The shroud gas is able to discharge from the open lower end of passage 40, so as to discharge into furnace or reactor gases above the bath.

Around at least part of the length of pipe 38, there is a supplemental cooling system 42. This comprises concentric pipes 44,46, each closed at their upper ends, with pipe 46 also closed at its lower end. Each pipe has a connector conduit 44*a*,46*a*, enabling the supply and discharge, respectively, of further coolant fluid, essentially as described in relation to circulation of such fluid within conduit 12. System 42 enhances overall cooling of lance 10 and, in particular, of shroud pipe 38, against the effect of furnace or reactor gases and heat of post-combustion.

The lance 10, for top submerged injection, will be appreciated as employing an external coolant circulation system, preferably utilising water as the coolant fluid. This provides a long operating life for the lance, obviating the need for frequent repairs. Lance 10 is used for injecting fuel, air and oxygen into a slag bath to provide heat, as well as vigorous stirring to achieve rapid and efficient reactions. It has particular advantages when used to inject coal as fuel and reductant with oxygen and air, to produce strongly reducing conditions at high temperatures, such as required to smelt and reduce iron from iron-containing materials. However, many other applications are envisaged, such as in smelting non-ferrous materials such as lateritic nickel smelting and ferro-alloy production.

The lance preferably is fabricated from stainless steel tubes or pipes, to prevent rusting and to provide resistance to high temperature oxidation. Tip 14 also preferably is of stainless steel while, as indicated, its internal cone half angle of 10° to 20° acts to prevent blockage by solidified slag. External water cooling maintains a low lance temperature, and in a system incorporating the lance, there preferably is a low pressure coolant fluid cut-off and lance raising mechanism.

The lance preferably has a minimum surface area, made permissible by an ability to maintain high velocities in gas and fuel flow. Typically, gas and fuel flows can range from Mach 0.05 to 1.0, preferably Mach 0.3 to 0.5. Similarly, high velocities of coolant flow enable minimum surface area for the lance, such as with coolant water flow of 1 to 5 m/sec.

Provision of shroud pipe 38 outside the conduit 12 enables air or other shroud gas to be injected above the bath. Such shroud gas provides cooling for the upper extent of lance 10. This shroud gas also can provide oxygen for above-bath reactions required for process reasons, such as achieving sufficient after-burning or post-combustion of carbon monoxide, hydrogen and carbon dust carried out of the bath during submerged injection. The position of shroud pipe 38 is optimised to allow maximum recovery of heat from such reactions to the bath, whilst avoiding re-oxidisation of the slag bath and metal products.

Provision of swirlers 36 in the oxygen/air duct enhance mixing of the injected materials before they enter the bath, and also provides stable discharge conditions for the injection of gas into the bath.

Provision of baffle 34 prevents slag from entering the tip and blocking flow.

The supplemental water cooled upper region, around the conduit 12, can be beneficial if the quantity of shroud gas discharged above the slag bath is not sufficiently large to prevent shroud pipe 38 from reaching temperatures which may cause oxidation or damage. The supplemental cooling preferably maintains the lower end of shroud pipe 38 at a temperature of from 400° to 800° C., depending on the material used.

A principal purpose of the invention is to allow injection of fuel, reductant, air and/or oxygen into a slag bath under conditions in which the lance is subjected to minimum wear and requires minimum maintenance. However, a further benefit where shroud pipe 38 is provided, is in enabling injection of after-burning air or oxygen into the gas space above the bath, in suitable proximity to the point of injection, to ensure heat release from after-burning efficiently heats the bath, whilst preventing re-oxidisation of the bath contents. This latter purpose has particular relevant to smelting and reducing iron-containing feed materials to produce metallic iron, in the form of pig iron or iron-containing less carbon than pig iron.

Finally, it is to be understood that various alterations, modifications and/or additions may be introduced into the constructions and arrangements of parts previously described without departing from the spirit or ambit of the invention.

We claim:

1. A top-submergable injection lance, for top submerged injection into a metallurgical bath, wherein the lance has an elongate conduit which, relative to the orientation of the lance in use, extends from an upper end inlet section to a lower, process fluid discharge end; the conduit defines a longitudinal bore extending therethrough from the inlet section, to an opening defined at the process fluid discharge end by an annular tip member mounted on the conduit, such that reactants for top submerged injection can be supplied through the bore; the conduit, between the inlet section and the discharge end, comprises an inner pipe which defines the bore, and an outer pipe, with an annular volume defined between the inner and outer pipes; the conduit is provided at, or adjacent to, the inlet section with a first and a second connector each communicating with the annular volume, with the first and second connectors adapted for respective connection to a coolant fluid supply line and a coolant fluid discharge line; wherein the lance further includes a third pipe which is intermediate the inner and outer pipes and divides the annular volume into an inner and an outer annular chamber with the third pipe extending from the inlet section and terminating a relatively short distance above the process fluid discharge end such that the chambers are in communication at the process fluid discharge end; each connector communicates with a respective one of the chambers, such that, in use, coolant fluid is able to flow from the first connector, through one of the chambers to the discharge end of the lance, and then return through the other of the chambers for discharge through the second connector; the tip is made of a suitable alloy steel and has a solid annular form defined by inner and outer peripheral surfaces, which merge at a sharp lower edge of the tip, and by a top surface which extends between the outer and inner peripheral surfaces; the annular tip at the process fluid discharge end of the conduit is connected at said top surface thereof to the lower end of each of the inner and outer pipes, around the circumference of those pipes, so as to be contacted by coolant fluid flow through said chambers; said frusto-conical inner peripheral surface providing a continuation of the bore, from the inner pipe to the opening, which is of increasing cross-section from the inner pipe to the opening; and wherein the lance further includes a shroud pipe around the conduit, over an upper part of the length of the latter from the inlet section, the shroud pipe defining an upper region shroud gas discharge passage between the shroud pipe and the outer pipe of the conduit, and wherein the shroud gas discharge passage being closed at the upper end of the shroud pipe and open at the lower end of the latter at a level spaced from the tip; the shroud pipe having a connector which communicates with the discharge passage and which is connectable to a supply of pressurized shroud gas such that, in use, shroud gas is able to be discharged into the furnace space, above the slag bath, during the course of top submerged injection of reactants into the bath.

2. The lance of claim 1, wherein the first connector communicates with the inner chamber, with the second connector enabling discharge from the outer chamber.

3. The lance of claim 1, wherein the frusto-conical surface has a half-cone angle of from about 10° to about 20°.

4. The lance of claim 1, wherein mounted in the tip, the lance has a baffle of a form which causes injected reactants to issue from the opening as an annular jet.

5. The lance of claim 4, wherein the baffle is of conical form, having an external surface which increases in cross-section from an upper end thereof to the opening.

6. The lance of claim 5, wherein the external surface of the baffle has a half-cone angle substantially equal to that of the inner surface of the tip.

7. The lance of claim 1, further including a fuel supply pipe extending through the bore from the inlet section to, or adjacent to, the tip for injection via the lance opening of fuel and a carrier gas for the fuel.

8. The lance of claim 7, wherein an annular passage is defined between the supply pipe and the inner pipe of the conduit, such that at least part of oxygen required for combustion then is supplied via the annular passage.

9. The lance of claim 7, the baffle is mounted by attachment to extensions or rods projecting beyond the lower end of the supply pipe, within the tip.

10. The lance of claim 8, wherein the annular passage between the fuel supply pipe and the inner pipe of the conduit is provided with at least one swirler mounted around at least the lower end of the supply pipe, to impart helical motion to the flow of gas injected through the passage.

11. The lance of claim 10, wherein the swirler is of helical form around the supply pipe.

12. The lance of claim 11, wherein the swirler is of decreasing pitch towards the opening.

13. The lance of claim 1, further including a shroud pipe around the conduit, over an upper part of the length of the latter from the inlet section, wherein the shroud pipe defines an upper region shroud gas discharge passage between the shroud pipe and the outer pipe of the conduit, and wherein the shroud gas discharge passage is closed at the upper end of the shroud pipe and open at the lower end of the latter at a level spaced from the tip; the shroud pipe having a connector which communicates with the discharge passage and is connectable to a supply of pressurised shroud gas such that, in use, shroud gas is able to be discharged into the furnace space, above the slag bath, during the course of top submerged injection of reactants into the bath.

14. A top submerged injection system, comprising the lance of claim 1, and lance positioning means operable to raise and lower the lance.

15. The system of claim 14, including pressure temperature and/or coolant flow sensing means for monitoring the coolant fluid supplied to the conduit means, and control means operable, in response to a signal from the sensing means indicating a drop in coolant fluid pressure or a coolant fluid pressure below a value, to shut off the coolant supply to the lance and to actuate the positioning means to raise the lance fully from an in use position.

* * * * *